US009265313B1

(12) United States Patent
Ma

(10) Patent No.: US 9,265,313 B1
(45) Date of Patent: Feb. 23, 2016

(54) MEMBER STRUCTURE FOR UMBRELLA FRAMEWORK

(71) Applicant: Joen-Shen Ma, Taipei (TW)

(72) Inventor: Joen-Shen Ma, Taipei (TW)

( * ) Notice: Subject to any disclaimer, the term of this patent is extended or adjusted under 35 U.S.C. 154(b) by 0 days.

(21) Appl. No.: 14/447,813

(22) Filed: Jul. 31, 2014

(51) Int. Cl.
*A45B 25/02* (2006.01)
*A45B 25/10* (2006.01)
*A45B 25/06* (2006.01)

(52) U.S. Cl.
CPC ..... *A45B 25/02* (2013.01); *A45B 25/06* (2013.01); *A45B 25/10* (2013.01)

(58) Field of Classification Search
CPC ..... A45B 25/02; A45B 25/10; A45B 19/00; A45B 2019/001; E04H 15/28; E04H 15/44; E04H 15/425
USPC ..... 135/28–32, 98
See application file for complete search history.

(56) References Cited

U.S. PATENT DOCUMENTS 959,127 A * 5/1910 Edwards ..... 135/31
1,001,076 A * 8/1911 Redford ..... 135/29
1,290,245 A * 1/1919 Kuehaner ..... 135/30
3,177,882 A * 4/1965 Militano ..... 135/28
3,252,468 A * 5/1966 Militano ..... 135/28
3,765,433 A * 10/1973 Futamura et al. ..... 135/15.1
4,285,609 A * 8/1981 Runyon ..... 403/172
4,821,756 A * 4/1989 England ..... 135/19.5
6,298,867 B1 * 10/2001 Chang ..... 135/28
8,393,340 B2 * 3/2013 Tung ..... 135/15.1
2004/0099301 A1 * 5/2004 Zhang et al. ..... 135/135
2007/0034242 A1 * 2/2007 Chuang ..... 135/30
2010/0059094 A1 * 3/2010 Ma ..... 135/28

FOREIGN PATENT DOCUMENTS

CN 201219565 Y * 4/2009 ..... A45B 25/02
JP 07298914 A * 11/1995 ..... A45B 25/06

* cited by examiner

*Primary Examiner* — Winnie Yip
(74) *Attorney, Agent, or Firm* — Liu & Liu

(57) ABSTRACT

An upper nest and a lower nest of an umbrella framework each comprise a nest body and a plurality of pins around the nest body. Each pin is integrally connected with the nest body via a connecting section. Each middle disk comprises a pin, which is disposed on an outer wall of a sleeve and integrally connected with the sleeve. Each long bone has an upper end thereof coupled with a pin of the upper nest, and the sleeve of each middle disk is fitted over a middle part of the long bone. Each short bone has an upper end thereof coupled with the pin of the middle disk, and a lower end thereof coupled with a pin of the lower nest. Thereby, an improved member structure for an umbrella framework is formed.

4 Claims, 7 Drawing Sheets

MEMBER STRUCTURE FOR UMBRELLA FRAMEWORK

BACKGROUND OF THE INVENTION

1. Technical Field

The present invention relates to an improved member structure for an umbrella framework, and more particularly, to an improved member structure for an umbrella framework of which an upper nest, a lower nest and a middle disk are formed integrally of a same material. As a result, the structure of these three members is simplified, fewer types of manufacturing material are required and the umbrella framework can be assembled more conveniently and rapidly.

2. Description of Related Art

Basic members of conventional umbrella frameworks comprise a middle rod, an upper nest, a lower nest, a plurality of long bones, the same number of supporting bones, and the same number of middle disks. The upper nest is fixed to a top end of the middle rod, and the lower nest is fitted over the middle rod and is capable of sliding up and down. Both the upper nest and the lower nest use metal rings which are disposed thereon or metal wires to have the long bones pivoted to the supporting bones, and the middle disk and a pivot are disposed on the middle section of each of the long bones so as to be pivoted to the corresponding supporting bone, and thereby an umbrella framework is formed.

The upper nest and the lower nest of the aforesaid conventional umbrella framework use metal rings inserted into the nest body to have the long bones pivoted to the supporting bones, or have metal wires threaded through the long bones and the supporting bones so as to form a pivot-connected structure. Therefore, at least two different materials are required for manufacturing and the process to assemble the long bones with the supporting bones is also complicated and inconvenient. Similarly, the conventional way to dispose the middle disk in the middle section of each of the long bones is to have the long bone drilled and then pivoted to the supporting bone, or have the metal middle disk fitted over the middle section of the long bone and then have the long bone pivoted to the supporting bone, so this conventional way also has the drawbacks that two different materials are required and the process to assemble the long bones with the supporting bones is complicated.

BRIEF SUMMARY OF THE INVENTION

The objective of the present invention is to provide an improved member structure for an umbrella framework so as to solve the drawbacks of the aforesaid conventional umbrella framework in manufacturing and assembling.

That is, the most obvious feature of the present invention is that the upper nest, the lower nest and the middle disk of the umbrella framework are formed integrally of a same material. As a result, the structure of these three members is simplified, fewer types of manufacturing material are required, the manufacturing cost is reduced and the umbrella framework can be assembled more conveniently and rapidly.

To achieve the aforesaid objective, the present invention adopts the following technical solution.

The improved member structure for an umbrella framework of the present invention comprises a middle rod, an upper nest, a lower nest, a plurality of long bones, the same number of supporting bones, and the same number of middle disks.

The upper nest is fixed to a top end of the middle rod, and the lower nest is fitted over the middle rod and is capable of sliding up and down.

The upper nest and the lower nest are of the same structure and comprise a nest body and a plurality of pins around a periphery of the nest body. Each of the pins is integrally connected with the nest body via a connecting section and each of the pins can swing up and down freely.

Each of the middle disks comprises a sleeve and a pin, an axial hole is disposed at an axis of the sleeve so that one of the long bones is inserted therein, the sleeve and the pin are integrally connected via a connecting section disposed on the outside wall of the sleeve so that the pin can swing up and down freely.

The upper end of each of the long bones can be connected with the pin of the upper nest, each of the middle disks can be inserted into the middle section of the long bone, the upper end of each short bone can be connected with the pin of the middle disk, and the lower end of the short bone can be connected with the pin of the lower nest, thereby constituting an umbrella framework.

The upper nest, including the nest body, the plurality of pins surrounding the nest body and the connecting section, is formed integrally of a same material.

The lower nest, including the nest body, the plurality of pins surrounding the nest body and the connecting section, is formed integrally of a same material.

The middle disks, including the sleeve, the pin and the connecting section, are formed integrally of a same material.

In manufacturing, since the upper nest, the lower nest and the middle disks are formed integrally of a same material, no metal ring needs to be inserted into the upper nest and the lower nest, and no metal wire needs to be threaded through the long bones and the supporting bones. In this way, the structure of these three members is simplified and only a single type of manufacturing material is required so that the manufacturing cost can be reduced.

In assembling, the upper nest and each of the long bones, the lower nest and each of the short bones, as well as each of the middle disks and the short bones can be connected with each other simply by the pins so that the umbrella framework can be assembled more conveniently and rapidly to achieve the expected objective of the present invention.

Specific embodiments of the present invention will be described in detail with reference to the following figures.

DETAILED DESCRIPTION OF THE INVENTION

Figure 1:
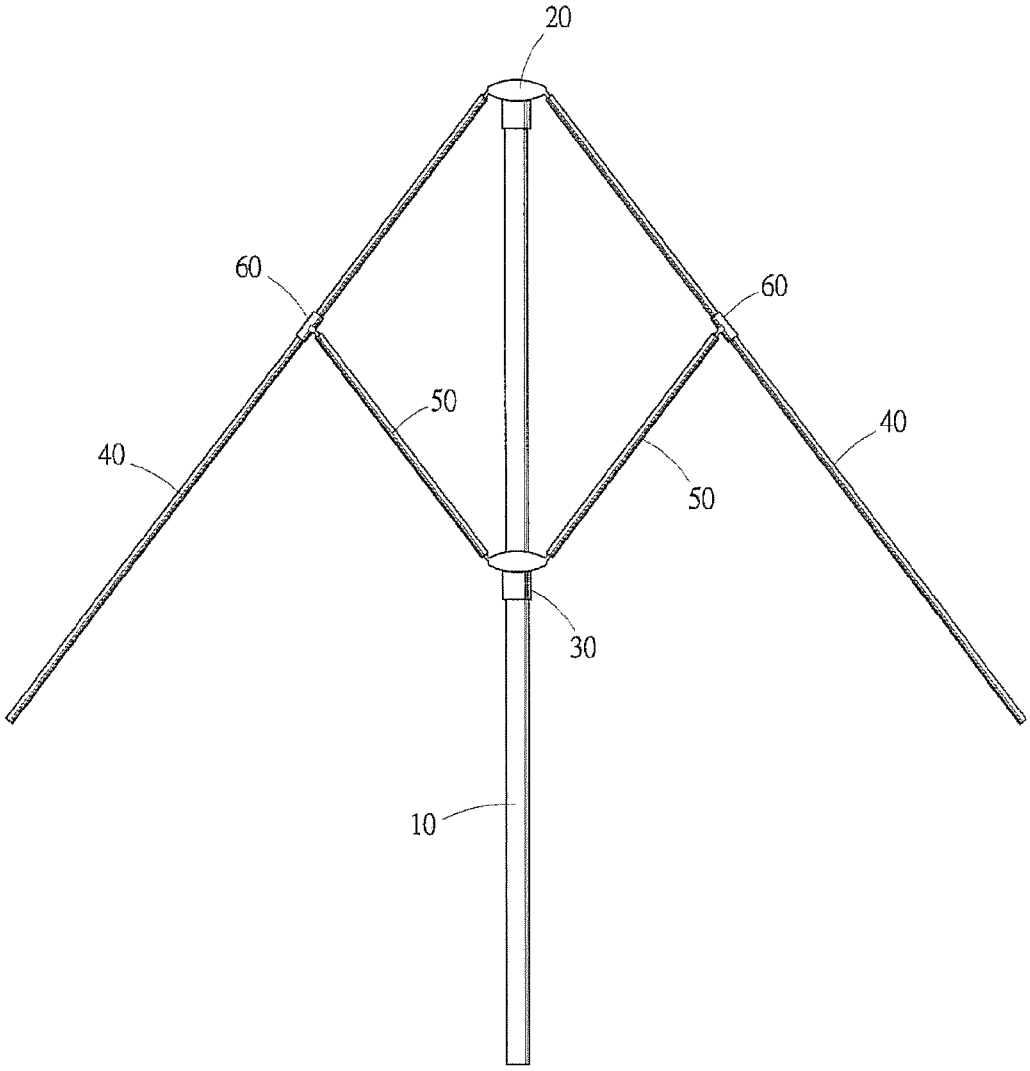
FIG. 1 is a schematic structural view of an umbrella framework of the present invention.

As shown in FIG. 1, the improved member structure for an umbrella framework of the present invention comprises a middle rod 10, an upper nest 20, a lower nest 30, a plurality of long bones 40, the same number of supporting bones 50, and the same number of middle disks 60.

As shown in FIG. 1, the upper nest 20 is fixed to a top end of the middle rod 10, and the lower nest 30 is fitted over the middle rod 10 and is capable of sliding up and down.

Figure 2:
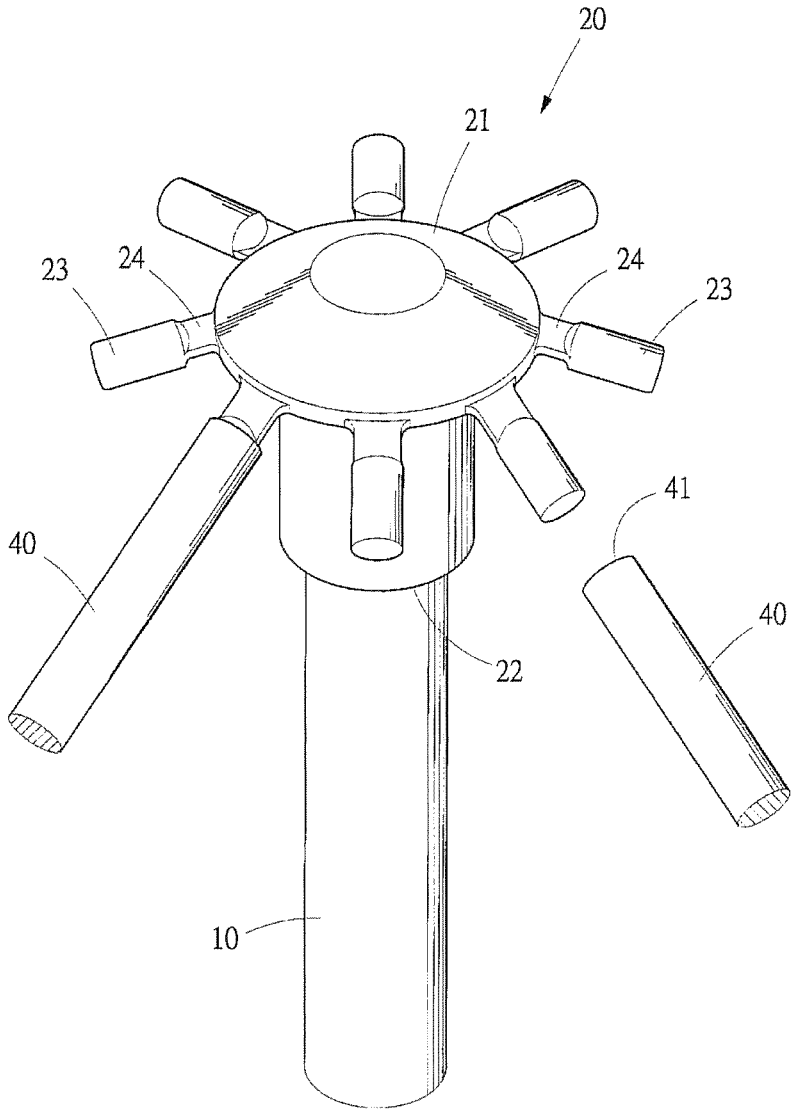
FIG. 2 is a perspective view of an upper nest member of the present invention.
Figure 3:
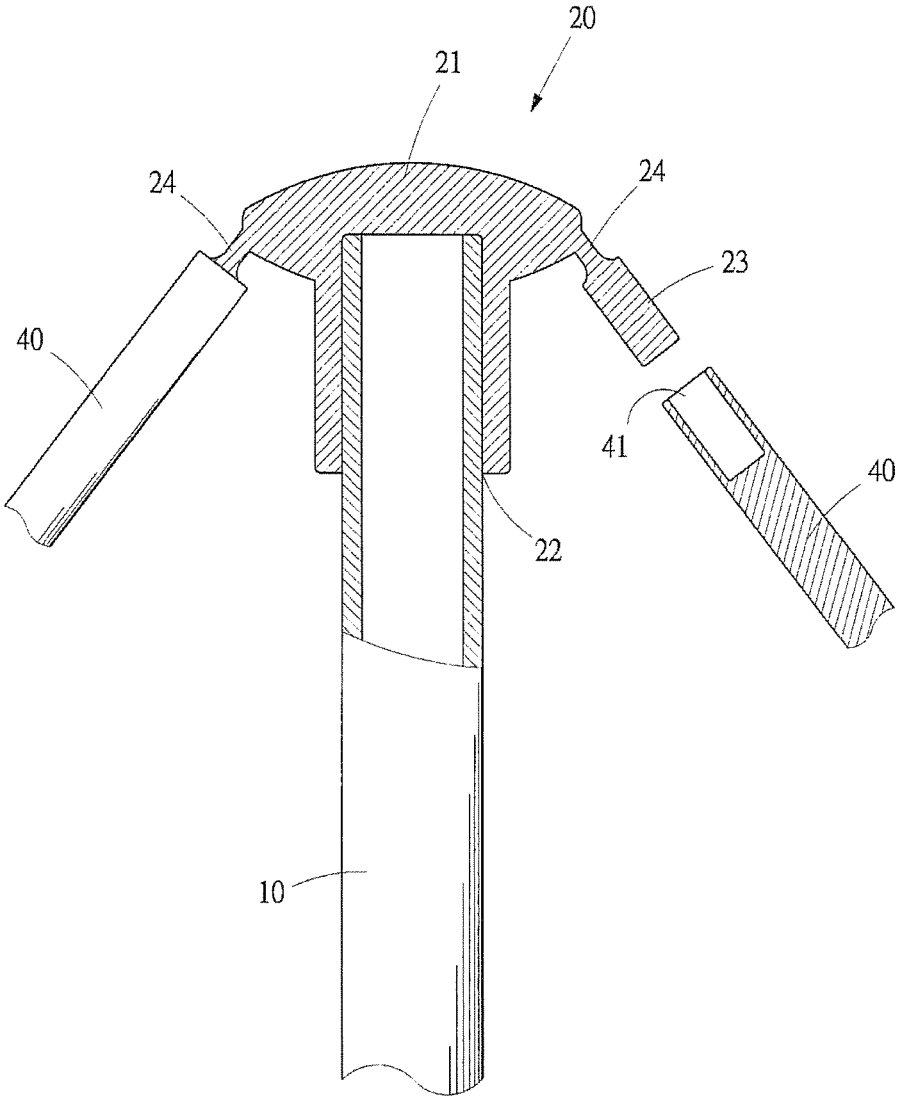
FIG. 3 is a cross-sectional view of the upper nest member of the present invention.

As shown in FIG. 2 and FIG. 3, the upper nest 20 comprises a nest body 21 and a plurality of pins 23 around a periphery of the nest body 21, an axial hole 22 is disposed at the bottom of the nest body 21 to receive the middle rod 10, each of the pins 23 is integrally connected with the nest body 21 via a connecting section 24, and each of the connecting sections 24 is freely bendable so that each of the pins 23 can swing up and down freely.

In practical manufacturing, each of the connecting sections 24 is preferably shaped as a flat structure so that it can be bent easily.

Figure 4:
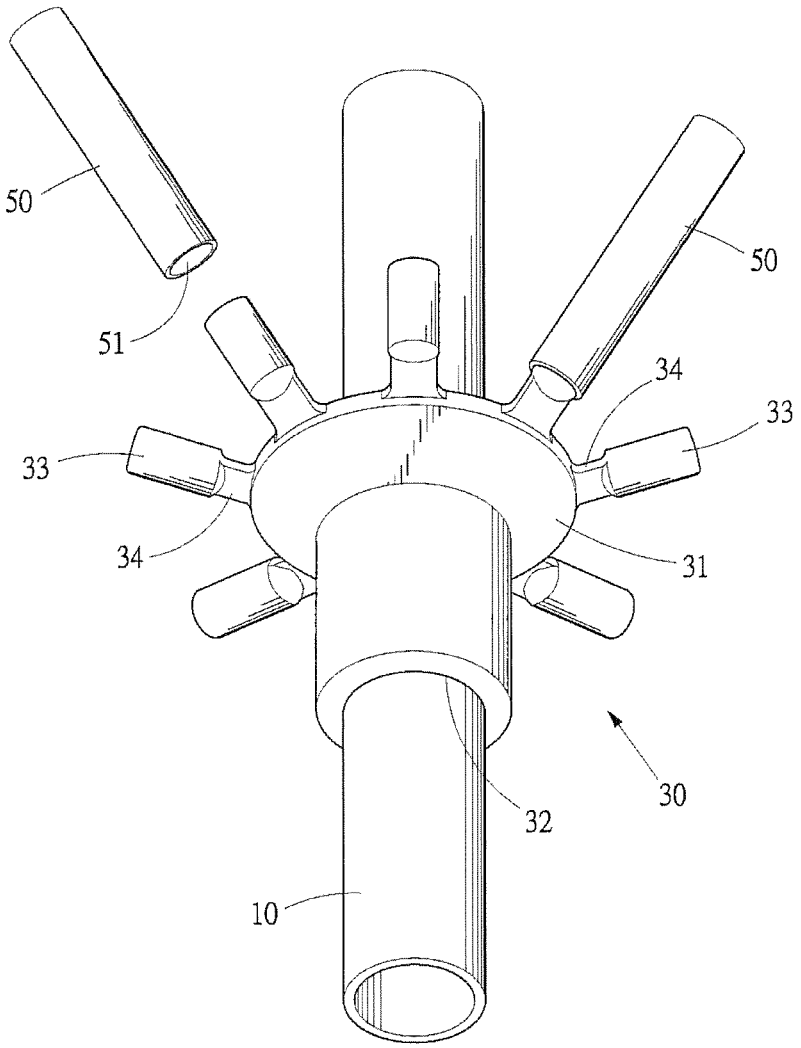
FIG. 4 is a perspective view of a lower nest member of the present invention.
Figure 5:
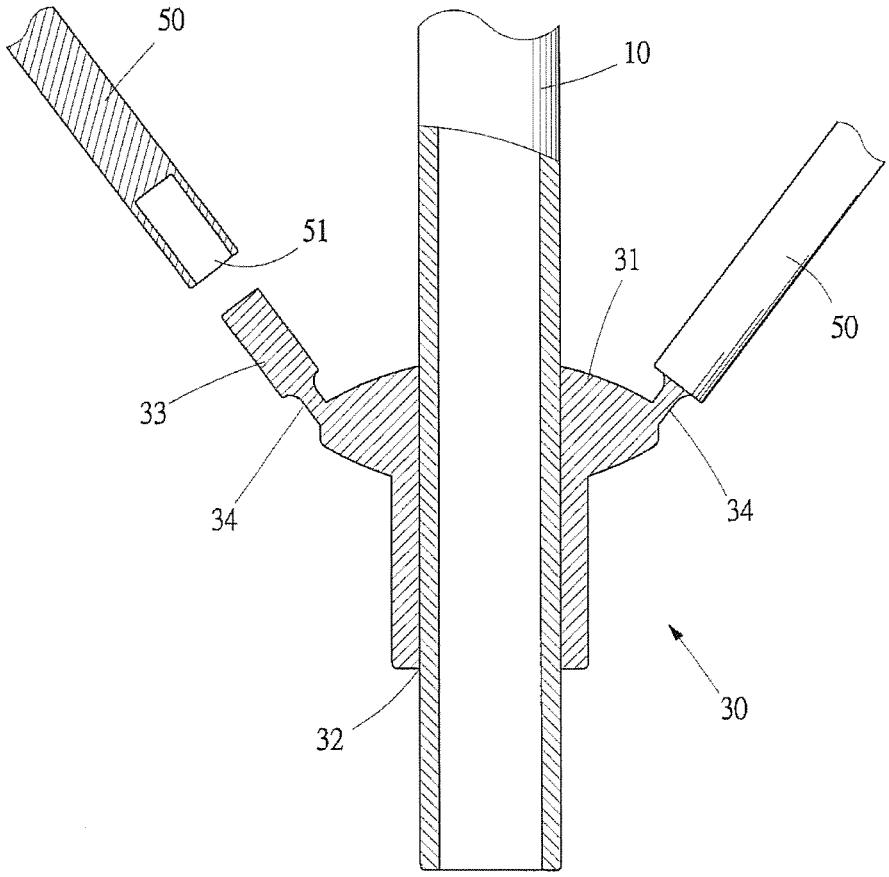
FIG. 5 is a cross-sectional view of the lower nest member of the present invention.

As shown in FIG. 4 and FIG. 5, the lower nest 30 comprises a nest body 31 and a plurality of pins 33 around the periphery of the nest body 31, an axial hole 32 is disposed at an axis end of the nest body 31 to receive the middle rod 10, each of the pins 33 is integrally connected with the nest body 31 via a connecting section 34, and each of the connecting sections 34 is freely bendable so that each of the pins 33 can swing up and down freely.

In practical manufacturing, each of the connecting sections 34 is preferably shaped as a flat structure so that it can be bent easily.

Figure 6:
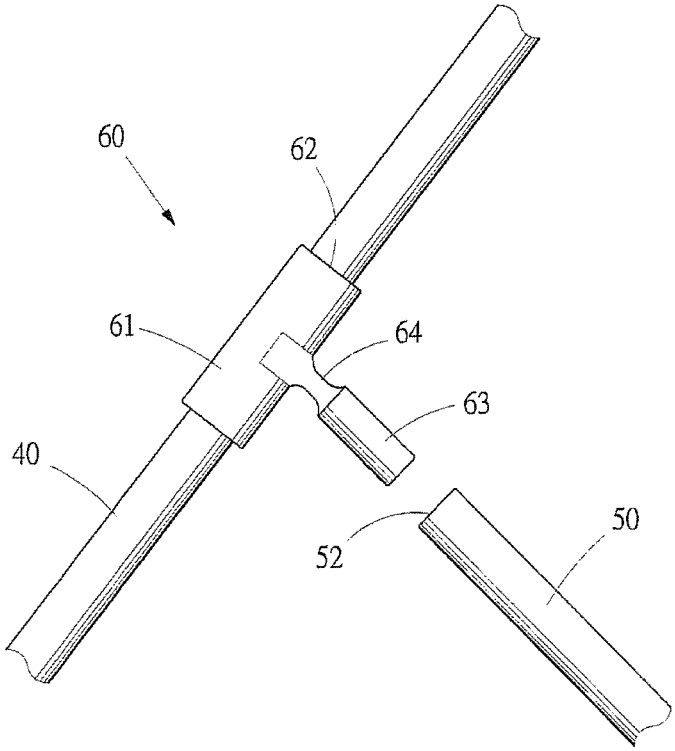
FIG. 6 is a plan view of a middle disk member of the present invention.
Figure 7:
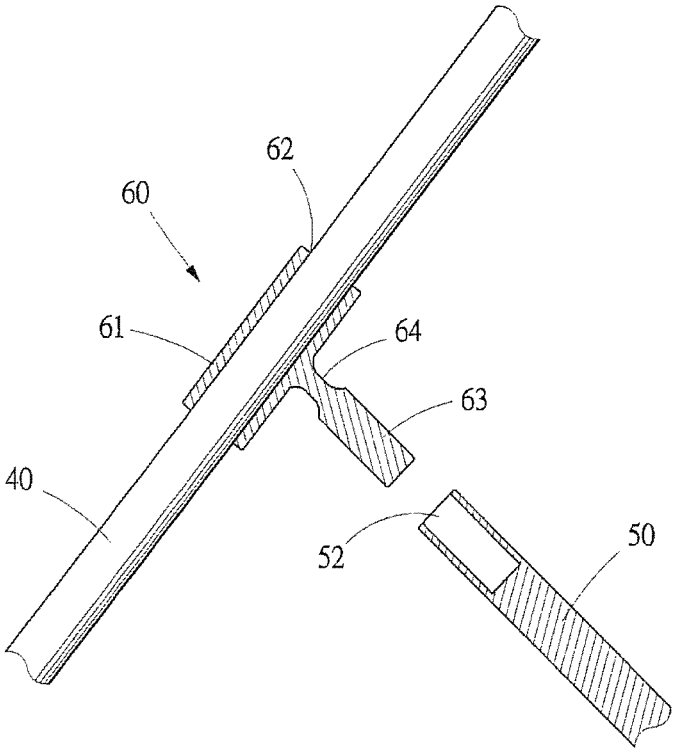
FIG. 7 is a cross-sectional view of the middle disk member of the present invention.

As shown in FIG. 6 and FIG. 7, each of the middle disks 60 comprises a sleeve 61 and a pin 63, an axial hole 62 is disposed at an axis of the sleeve 61 so that one of the long bones 40 is inserted therein, the sleeve 61 and the pin 63 are integrally connected via a connecting section 64, and the connecting section 64 is freely bendable so that the pin 63 can swing up and down freely.

In practical manufacturing, the connecting section 64 on each of the middle disks 60 is preferably shaped as a flat structure so that it can be bent easily.

As shown in FIG. 1 and FIG. 3, each of the plurality of long bones 40 has an axial hole 41 disposed at an upper axis end thereof, and the pins 23 around the upper nest 20 are adapted to be directly inserted into the axial holes 41 so that the upper end of each of the long bones 40 is pivoted to the upper nest 20.

As shown in FIG. 1 and FIG. 5, each of the plurality of supporting bones 50 has an axial hole 51 disposed at a lower axis end thereof and an axial hole 52 disposed at an upper axis end thereof as shown in FIG. 7, and the pins 33 surrounding the lower nest 30 are adapted to be directly inserted into the axial holes 51 disposed at the lower axis ends of the supporting bones 50 so that the lower end of each of the supporting bones 50 are pivoted to the lower nest 30.

As shown in FIG. 1 and FIG. 7, each of the long bones 40 is inserted into the axial hole 62 of the sleeve 61 of each of the middle disks 60, and the pins 63 of the middle disks 60 can be directly inserted into the axial holes 52 disposed at the upper end of the supporting bones 50 so that each of the long bones 40 can be pivoted to the corresponding supporting bone 50 via each of the middle disks 60.

After the upper nest 20 is pivoted to the upper end of each of the long bones 40, the lower nest 30 is pivoted to the lower end of each of the supporting bones 50, and each of the middle disks 60 is pivoted to the upper end of each of the supporting bones 50, the assembling of an umbrella framework is finished.

The pins 23 around the periphery of the upper nest 20 and the axial holes 41 disposed at the upper end of the long bones 40, the pins 33 around the periphery of the lower nest 30 and the axial holes 51 disposed at the lower end of the supporting bones 50, the sleeves 61 of the middle disks 60 and the long bones 40, as well as the pins 63 of the middle disks 60 and the axial holes 52 disposed at the upper end of the supporting bones 50 can also be fixed together by other means, e.g., the contact portions of the aforesaid members can be connected together securely by high frequency welding, or via adhesive or a radial pin.

The upper nest 20, including the nest body 21, the plurality of pins 23 surrounding the nest body 21 and the connecting section 24, is formed integrally of a same material.

The lower nest 30, including the nest body 31, the plurality of pins 33 surrounding the nest body 31 and the connecting section 34, is formed integrally of a same material.

Each of the middle disks 60, including the sleeve 61, the pin 63 and the connecting section 64, is formed integrally of a same material.

In practical manufacturing, the upper nest 20, the lower nest 30 and the middle disks 60 are preferably made of a thermoplastic material, such as high strength polypropylene (PP). This thermoplastic material can provide the upper nest 20, the lower nest 30 and the middle disks 60 with strong mechanical property and impact resistance after they are formed, and provide the flat connecting section with necessary bending resistance, and the material can also resist the corrosion of a plurality of organic solvents and acid-alkali corrosion.

Of course, the upper nest 20, the lower nest 30 and the middle disks 60 can also be integrally formed of other thermoplastic materials with same or similar physical properties as the high strength PP.

The advantages of the improved member structure for an umbrella framework of the present invention are apparent as follows: since the upper nest 20, the lower nest 30 and the middle disks 60 are formed integrally, no metal ring needs to be inserted into the upper nest 20 and the lower nest 30, and no metal wire needs to be threaded through the long bones 40 and the supporting bones 50; in this way, the structure of these three members is simplified and only a single type of manufacturing material is required so that the manufacturing cost can be reduced.

In addition, the upper nest 20 and each of the long bones 40, the lower nest 30 and each of the short bones 50, as well as each of the middle disks 60 and the short bones 50 can be connected with each other simply by the pins so that the umbrella framework can be assembled more conveniently and rapidly to achieve the expected objective of the present invention.

What is claimed is:

1. An improved umbrella framework structure, comprising a middle rod, an upper nest, a lower nest, a plurality of long bones, the same number of supporting bones, and the same number of middle disks, the upper nest being fixed to a top end of the middle rod, and the lower nest being fitted over the middle rod and being capable of sliding up and down, wherein:

the upper nest comprises a nest body and a plurality of pins integrally formed with the nest body to project radially outward therefrom, an axial hole is disposed at the bottom of the nest body to receive the middle rod, each of the pins is integrally connected with the nest body via a connecting section, and each of the connecting sections is freely bendable so that the pin can swing up and down freely;

the lower nest comprises a nest body and a plurality of pins integrally formed with the nest body to project radially outward therefrom, an axial hole is disposed at an axis end of the nest body to receive the middle rod, each of the pins is integrally connected with the nest body via a connecting section, and each of the connecting sections is freely bendable so that the pin can swing up and down freely;

each of the plurality of long bones has an axial hole disposed at an upper axis end thereof, and the pins projecting radially outward from the nest body of the upper nest are adapted to be directly inserted into the axial holes so that the upper end of each of the long bones is pivoted to the upper nest;

each of the plurality of supporting bones has an axial hole disposed at a lower axis end thereof and an axial hole disposed at an upper axis end thereof, and the pins projecting radially outward from the nest body of the lower nest are adapted to be directly inserted into the axial holes disposed at the lower axis ends of the supporting bones so that the lower end of each of the supporting bones are pivoted to the lower nest; and each of the middle disks comprises a sleeve and a pin, an axial hole is axially disposed through the sleeve so that one of the long bones is inserted therein, the sleeve and the pin are integrally connected via a connecting section, the connecting section is freely bendable so that the pin can swing up and down freely, and the pin is adapted to be directly inserted into the axial hole disposed at the upper end of the respective supporting bone so that the upper end of each of the supporting bones is pivoted to the respective middle disk.

2. The improved umbrella framework structure of claim 1, wherein the upper nest, including the nest body, the plurality of pins surrounding the nest body and the connecting section, is formed integrally of a same material.

3. The improved umbrella framework structure of claim 1, wherein the lower nest, including the nest body, the plurality of pins surrounding the nest body and the connecting section, is formed integrally of a same material.

4. The improved umbrella framework structure of claim 1, wherein each of the middle disks, including the sleeve, the pin and the connecting section, is are formed integrally of a same material.

* * * * *